US011382352B2

(12) United States Patent
Yamay

(10) Patent No.: US 11,382,352 B2
(45) Date of Patent: Jul. 12, 2022

(54) SYSTEM AND METHOD FOR FOLDING CIGARETTES

(71) Applicant: HEFESTUS TECHNOLOGIES LTD., Petah Tiqva (IL)

(72) Inventor: Yehuda Yamay, Binyamina (IL)

( * ) Notice: Subject to any disclaimer, the term of this patent is extended or adjusted under 35 U.S.C. 154(b) by 7 days.

(21) Appl. No.: 17/089,812

(22) Filed: Nov. 5, 2020

(65) Prior Publication Data

US 2022/0132910 A1 May 5, 2022

(51) Int. Cl.
*A24C 5/54* (2006.01)

(52) U.S. Cl.
CPC ..... *A24C 5/54* (2013.01)

(58) Field of Classification Search
CPC ..... A24C 5/54
See application file for complete search history.

(56) References Cited

U.S. PATENT DOCUMENTS

2019/0320710 A1* 10/2019 Sirois ..... A24C 5/12
2019/0329514 A1* 10/2019 Holderman ..... A24C 5/06

* cited by examiner

*Primary Examiner* — Eric Yaary
(74) *Attorney, Agent, or Firm* — Alphapatent Associates, Ltd; Daniel J. Swirsky

(57) ABSTRACT

A system for folding cigarettes filled with a smoking material, including a body, an insert coupled to the body, the insert is configured to store the cigarette, the insert includes a base and sidewalls extending upwards from the base, where the base and the sidewalls match a size of the cigarette, the insert, the cigarette is configured to be mounted on a top surface of the base, a folding mechanism secured to the body, the folding mechanism includes multiple folding units, each folding unit of the multiple folding units includes a moving member that moves towards the insert for hitting a top portion of the cigarette from another angle, a mechanism for moving the moving member towards the cigarette.

11 Claims, 6 Drawing Sheets

SYSTEM AND METHOD FOR FOLDING CIGARETTES

FIELD

The present invention generally relates to systems and methods for folding cigarettes.

BACKGROUND

Various countries permit both the recreational and medical use of cannabis for the delivery of THC (Δ9-tetrahydrocannabinol), CBD (cannabidiol), and other cannabinoids to a user. Inhaling combusted cannabis is the most common, effective, and least expensive method for delivering a pharmacological action to the brain and body. One convenient method for smoking cannabis is to hand-roll loose cannabis stock into a cigarette. However, when manufacturing cigarettes to be consumed by users on a regular manner, one has to fold the cigarette after filling the cigarette with the smoking material. Folding a cannabis cigarette is unique in the field of smoking devices, as there is no need to fold a tip of a tobacco cigarette. The need to fold the cannabis cigarette comes from multiple areas, such as preventing the smoking material to fall from the cigarette, as the amount of smoking material should be accurate, when the cannabis cigarette is consumed for medical purposes. In addition, the cannabis material is much more expensive than tobacco, and consumers may weigh the cigarette prior to consumption. Current methods of manufacturing cannabis cigarettes involve manual processes, such as weighing the accurate amount of smoking material for filling the cigarette, filling the accurate amount of smoking material into the cigarette and folding the cigarette. This manual process yields human errors and incurs many costs on the manufacturer of the cannabis cigarettes.

SUMMARY

The subject matter discloses a system for folding cigarettes filled with a smoking material, comprising a body, an insert coupled to the body, said insert is configured to store the cigarette, said insert comprises a base and sidewalls extending upwards from the base, wherein the base and the sidewalls match a size of the cigarette, said insert, the cigarette is configured to be mounted on a top surface of the base, a folding mechanism secured to the body, said folding mechanism comprises multiple folding units, each folding unit of the multiple folding units comprises a moving member that moves towards the insert for hitting a top portion of the cigarette from another angle, a mechanism for moving the moving member towards the cigarette. In some cases, the system further comprising a controller for controlling a time in which each folding unit of the multiple folding units hits a top portion of the cigarette.

In some cases, each folding unit of the multiple folding units has a resting position in which the folding unit in which the folding unit is located away from the insert and a folding position in which the folding unit is located near the insert. In some cases, the system further comprising a top mount placed above a top most point of the insert, wherein each folding unit of the multiple folding units is located in its entirety in the top mount when the folding unit is in the resting position. In some cases, the top mount is coupled to multiple housings, each of the multiple housings is configured to secure one of the multiple folding units.

In some cases, the system further comprising an adjuster for adjusting a distance between the top mount and the insert. In some cases, each folding unit of the multiple folding units comprises a housing, said housing is coupled to the body and contains the moving member, wherein the moving member moves inside the housing when moving towards the cigarette. In some cases, the mechanism is an air pump, wherein each of the multiple folding units comprises a gas inlet for receiving gas into a niche of the housing, such that passage of the gas into the housing results in movement of the moving member.

In some cases, each of the multiple folding units comprises a front gas inlet for receiving gas into a front niche of the housing and a rear gas inlet for receiving gas into a rear niche of the housing, such that passage of the gas into the front niche results in movement of the moving member back from the cigarette and passage of the gas into the rear niche results in movement of the moving member towards the cigarette.

In some cases, the controller is electrically coupled multiple valves, each valve of the multiple valves controls gas flow from a gas container to a niche in one of the multiple folding units, such that opening a valve results in movements of a moving member of one of the multiple folding units towards the cigarette or away from the cigarette. In some cases, the base is located in a bottom side of the insert, pointing to the ground. In some cases, the controller commands only one of the folding units to touch the cigarette.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

The following detailed description of embodiments of the invention refers to the accompanying drawings referred to above. Dimensions of components and features shown in the figures are chosen for convenience or clarity of presentation and are not necessarily, shown to scale. Wherever possible, the same reference numbers will be used throughout the drawings and the following description to refer to the same and like parts.

DETAILED DESCRIPTION

The subject matter discloses a system for manufacturing cigarettes filled with a smoking material. The system comprises a folding mechanism having multiple folding units, the multiple folding units fold the upper portion of the cigarette. The folding mechanism is secured to the body of the system, as well as an insert in which the cigarette is mounted during the folding process. The multiple folding units are located above the top most point of the cigarette when located inside the insert. Each of the multiple folding units moves towards the cigarette from another angle, all the angles are from an upper direction—one is from upper right, upper left, upper front and upper bottom. This way, the upper section of the cigarette folds according to the direction from which the multiple elements hit the cigarette.

Figure 1:
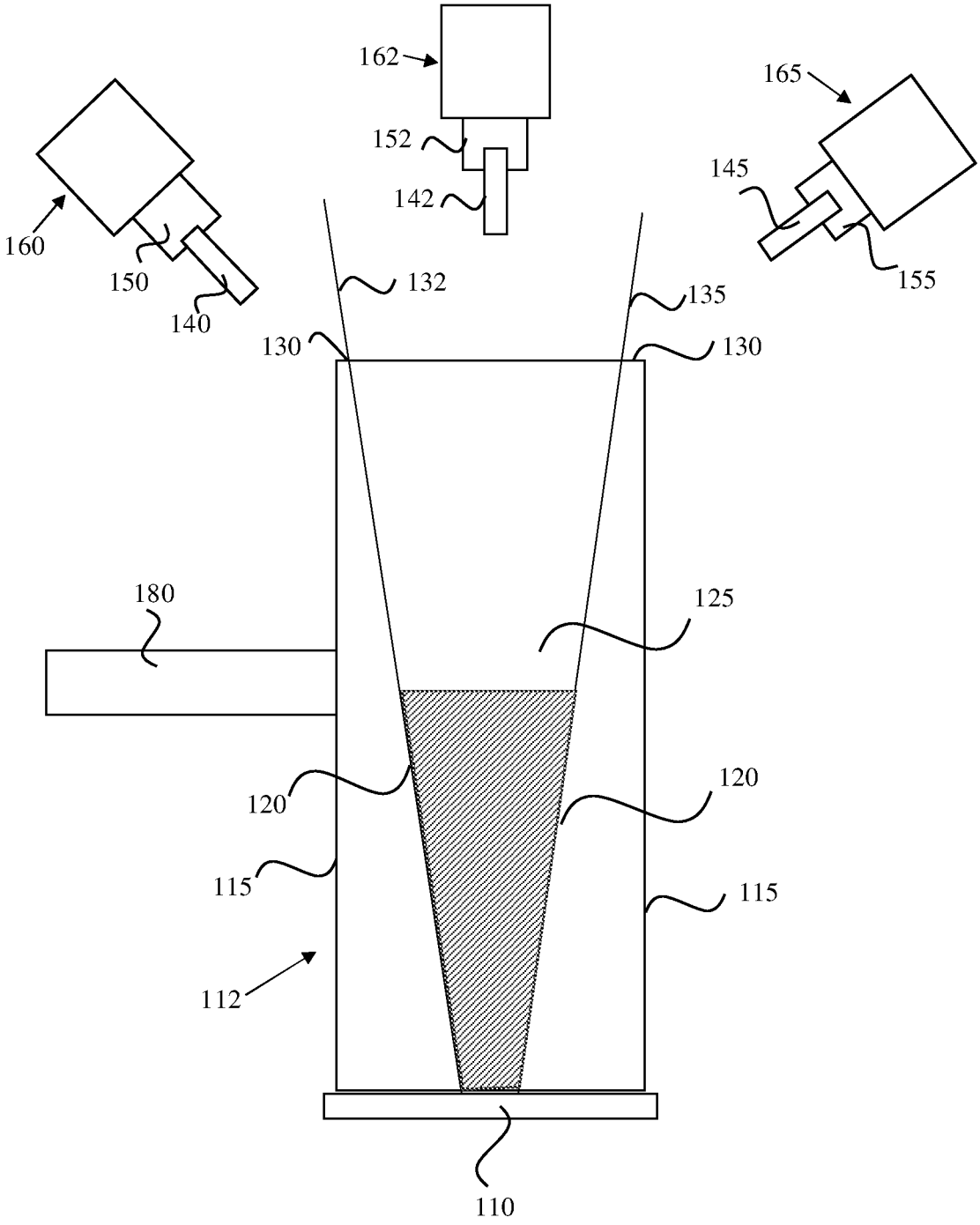
FIG. 1 shows a cigarette located inside an insert and a plurality of folding units, according to exemplary embodiments of the present invention.

FIG. 1 shows a cigarette located inside an insert and a plurality of folding units, according to exemplary embodiments of the present invention. The cigarette is located inside an insert 112. The insert 112 comprises a base 110 and sidewalls 115 extending from the base 110. The insert 112 is coupled to the body of the system for filling the cigarettes, for example using arm 180 that connects the base 110 or the sidewalls 115 to the body. The arm 180 may move the insert 112 from one place to another, for example from a filling station in which the cigarette is filled to a folding station comprising the folding mechanism.

The sidewalls 115 end in a top most point 130 of the insert 112. The top most point 130 surrounds an aperture of the insert 112, via which the cigarette is placed into the insert 112. The cigarette comprises a main section 120 that contains the smoking material 125 and a top section 135. The top section 135 may be defined as a top 10-30 percent of the longitudinal side of the cigarette. When the cigarette is in the insert 112, the top section 135 extends higher than the top most point 130 of the insert 112. The base 110 and sidewalls 115 of the insert 112 are made of a rigid material, for example metal, plastics and the like, such that only the top section 135 can be folded by the multiple folding units of the folding mechanism.

The folding mechanism comprises multiple folding units 160, 162, 165, each move folding units of the multiple folding units 160, 162, 165 hits the top portion 135 of the cigarette from another angle. All the angles comprise a downward component, as the multiple folding units 160, 162, 165 are located above the top portion 135 when beginning the movement towards the top portion 135 of the cigarette. In an exemplary embodiment, when hitting the top portion 135 of the cigarette, the multiple folding units 160, 162, 165 do not touch the insert 112, to keep the insert 112 for next use. In some other cases, at least a portion of the insert 112 may be disposable and folded by the multiple folding units 160, 162, 165.

The folding units 160, 162, 165 comprise a housing and a moving member. For example, folding unit 160 comprises housing 150 and moving member 140, folding unit 162 comprises housing 152 and moving member 142 and folding unit 165 comprises housing 155 and moving member 145. The housings 150, 152, 155 are secured to the body of the system, and remain in place while the moving members 140, 142, 145 move towards the top portion 135 of the cigarette during the folding process. The moving members 140, 142, 145 are placed inside the housings 150, 152, 155 when in the resting position, and extend from the housings 150, 152, 155 when in the folding position.

Figure 2:
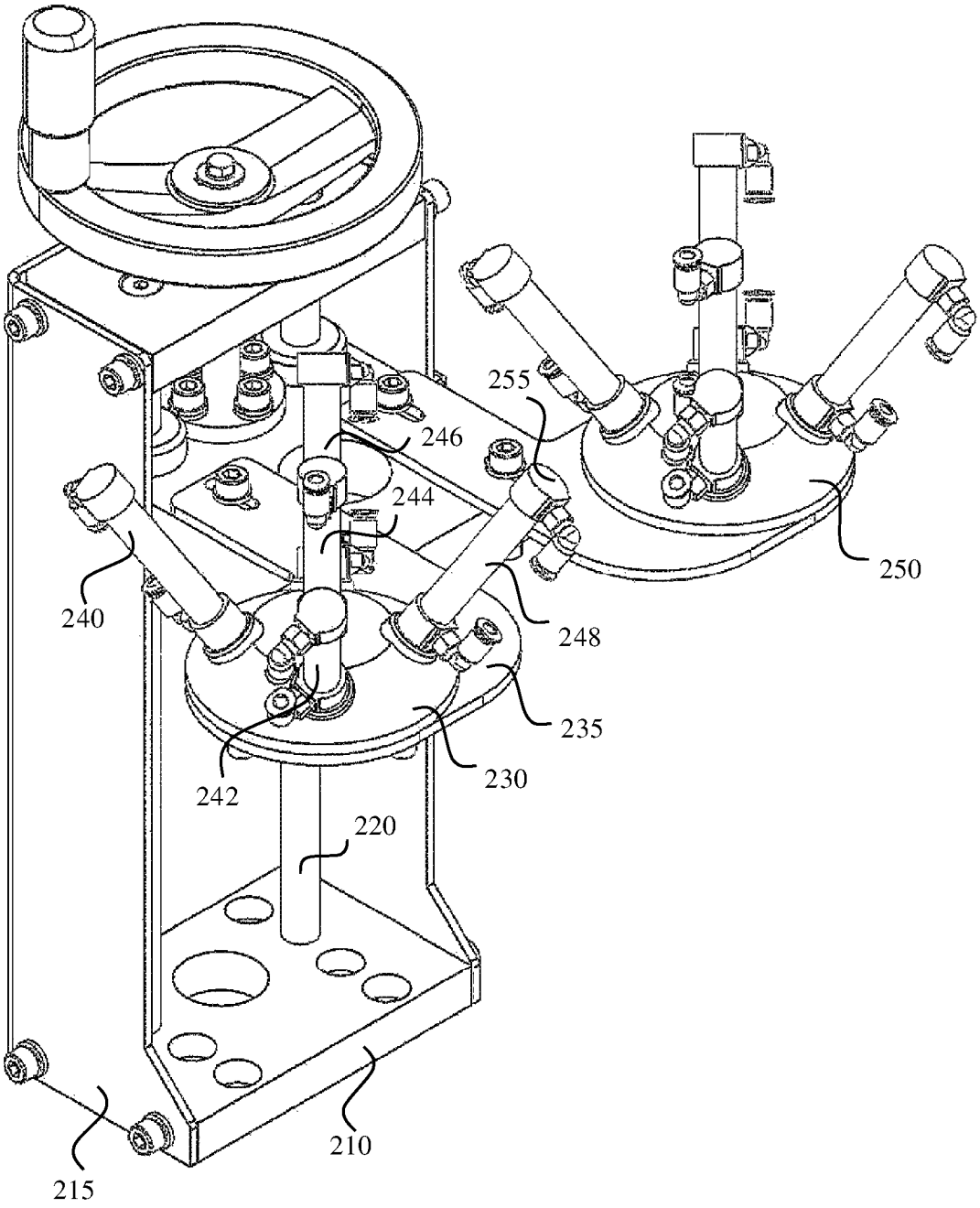
FIG. 2 shows a body of the system for filling cigarettes and a plurality of folding units for folding a cigarette, according to exemplary embodiments of the present invention.

FIG. 2 shows a body of the system for filling cigarettes and a plurality of folding units for folding a cigarette, according to exemplary embodiments of the present invention. The body comprises a base structure 210 configured to be placed on a horizontal surface such as the ground or a floor. Lateral structure 215 extends upwards from the base, for carrying the elements of the system higher than the base structure 210. The lateral structure 215 may comprise one or more components extending from the base structure 210, for example two elongated plates, each elongated plate is connected to a different top mount connectors 235, 255. In some other cases, the system may comprise a single top mount connector, and a single top mount. The top mounts 230, 250 secure multiple folding units moving downwards, in the direction of the base structure, to fold the top portion 135 of the cigarette. For example, the top mount 230 may be connected to the lateral structure 215 as part of the body of the system via top mount connector 235. Similarly, the top mount 250 may be connected to the lateral structure 215 as part of the body of the system via top mount connector 255.

The top mount 250 forms a base for folding units 240, 242, 244, 246 and 248. The housings of the folding units 240, 242, 244, 246 and 248 are secured to the top mount 250. The top mount 250 comprises one or more holes via which the moving members of the folding units 240, 242, 244, 246 and 248 move towards the top portion 135 of the cigarette. Having multiple top mounts and multiple sets of folding units enables the system to fold multiple cigarettes concurrently. The moving members of the folding units 240, 242, 244, 246 and 248 move towards the top portion 135 of the cigarette in a manner that does not interfere with each other. For example, only one moving member can be in physical contact with the top portion 135 of the cigarette at any given time. As each time another part of the top surface 135 folds towards the center of the cross section of the insert 112, two or more moving members would prevent the folding movement of that part. The folding units 240, 242, 244, 246 and 248 may be located in a united manner around the cross section of the top portion 135 of the cigarette. That is, folding unit 240 is located on a right side of the top mount 250, folding unit 242 is located on a front side of the top mount 250, folding unit 246 is located on a rear side of the top mount 250, folding unit 248 is located on a left side of the top mount 250, and folding unit 244 is located on a directly above the top portion 135 of the cigarette. In some exemplary cases, the folding unit located on a directly above the top portion 135 of the cigarette is last to move towards the cigarette. In some exemplary cases, each moving member touches the top portion 135 of each cigarette once.

Figure 3:
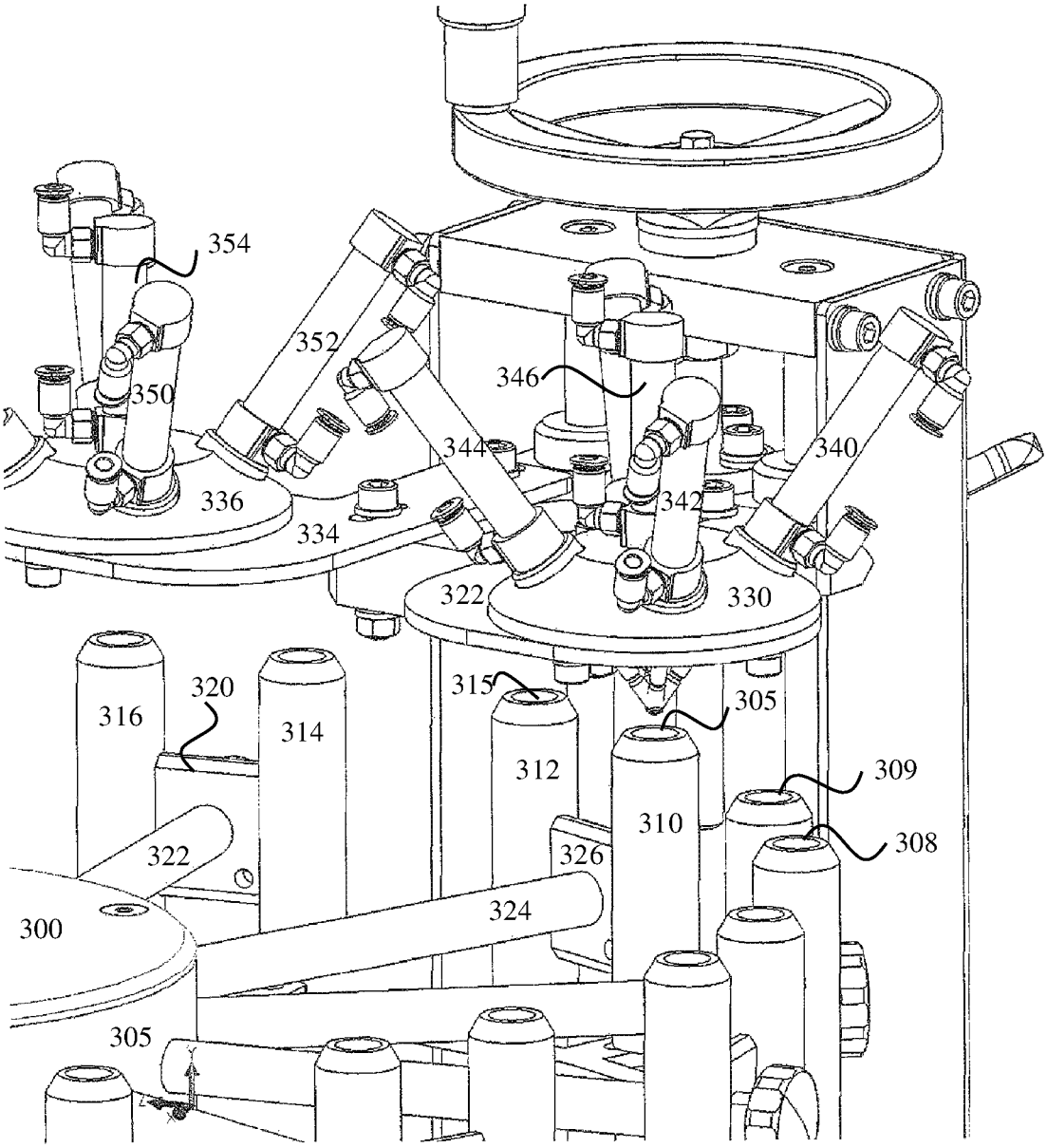
FIG. 3 shows a body of the system for filling cigarettes, multiple inserts moving in the system and two folding mechanisms for folding a cigarette, according to exemplary embodiments of the present invention.

FIG. 3 shows a body of the system for filling cigarettes, multiple inserts moving in the system and two folding mechanisms for folding a cigarette, according to exemplary embodiments of the present invention. The system comprises multiple inserts, such as inserts 310, 312, 314 and 316. The inserts 310, 312, 314 and 316 are configured to carry the cigarettes. The inserts 310, 312, 314 and 316 are of a size and shape to match the size and shape of the cigarette, for example a conical shape, or a circular cross sectional shape. The inserts 310, 312, 314 and 316 may be movable from one station of the system for manufacturing cigarettes to another station. For example, the cigarettes moved inside the inserts 310, 312, 314 and 316 may enter the system empty at an entrance station, in which they reach the inserts 310, 312, 314 and 316, then move to a filling station where the cigarettes are filled, then to a folding station etc.

The inserts 310, 312, 314 and 316 are connected to the body of the system. The inserts 310, 312, 314 and 316 may move between the stations of the system in a circular manner, moved by rotating axis 300. The rotating axis 300 is coupled to a power source, such as the power grid or a battery. The rotating axis 300 is coupled to the inserts 310, 312, 314 and 316 via axis arms, such as axis arms 322 and 324. The axis arms 322 and 324 are secured to the lateral side 305 of the rotating axis 300, such that rotational movement of the rotating axis 300 move the distal end of the axis arms 322 and 324 in a circular manner, said distal end of the axis arms is where the inserts 310, 312, 314 and 316 are connected to the axis arms 322 and 324.

The system also comprises two folding mechanisms. The first folding mechanism comprises top mount 330 and the second folding mechanism comprises top mount 336. The top mount 330 is connected to the body of the system using top mount connector 332 and the top mount 336 is connected to the body of the system using top mount connector 334.

In some exemplary embodiments, the inserts are arranged in couples. For example, one couple comprises inserts 310 and 312, connected together using coupling arm 326 and another couple comprises inserts 314 and 316, connected together using coupling arm 320. The distance between inserts in each couple matches the distance between the top mounts 330, and 336, such that in each folding cycle, both the top mounts 330, 336 fold a cigarette. For example, in one folding cycle, the folding mechanism having top mount 330 folds the cigarette inside insert 308 and the folding mechanism having top mount 336 folds the cigarette inside insert 312. In the next folding cycle, the folding mechanism having top mount 330 folds the cigarette inside insert 310 and the folding mechanism having top mount 336 folds the cigarette inside insert 316.

The top mount 330 is coupled to folding units 340, 342, 344, 346. Folding unit 346 is the folding unit located directly above the insert 310. The top mount 336 is coupled to folding units 350, 352, 354. The number of folding units in a folding mechanism may vary and chosen by a person skilled in the art, for example being in the range of 2-8.

Figure 4A:
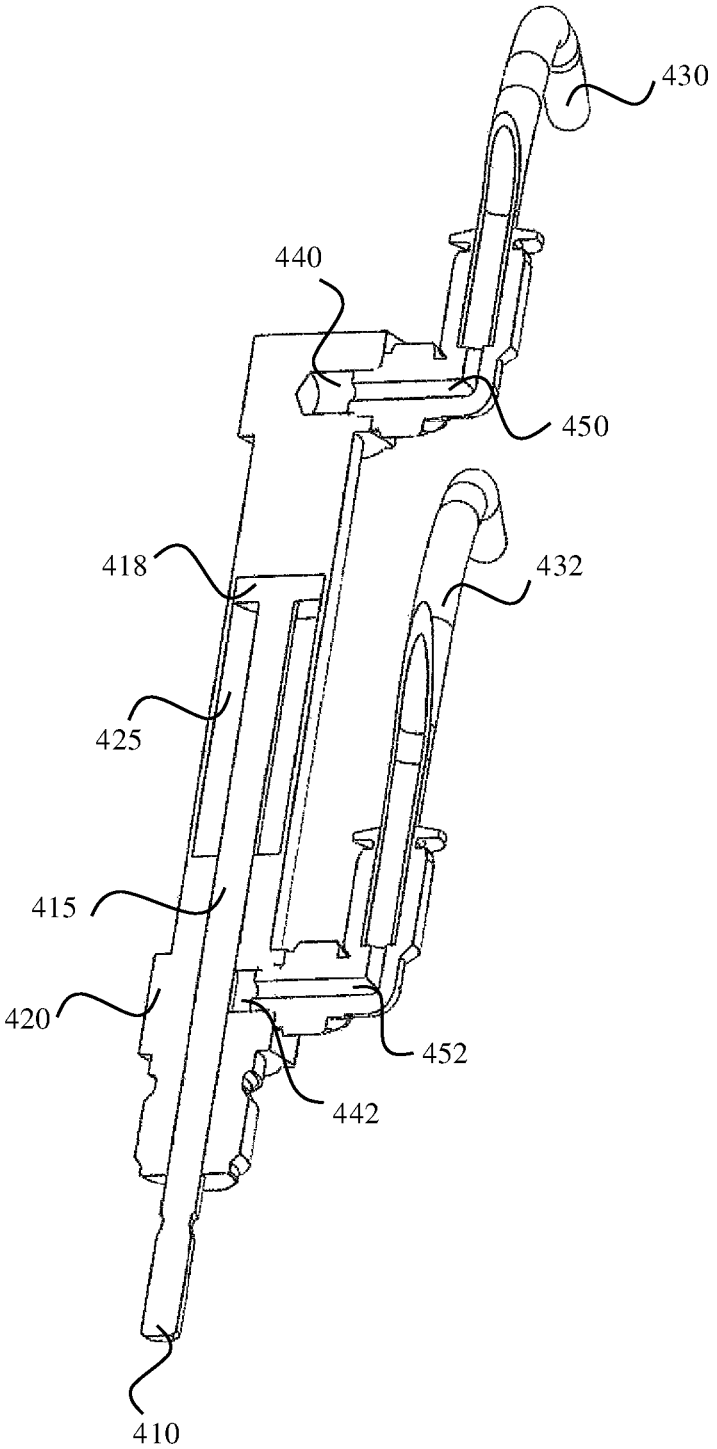
FIGS. 4A-4B show a cross section of a folding unit with a moving member therein, according to exemplary embodiments of the present invention.
Figure 4B:
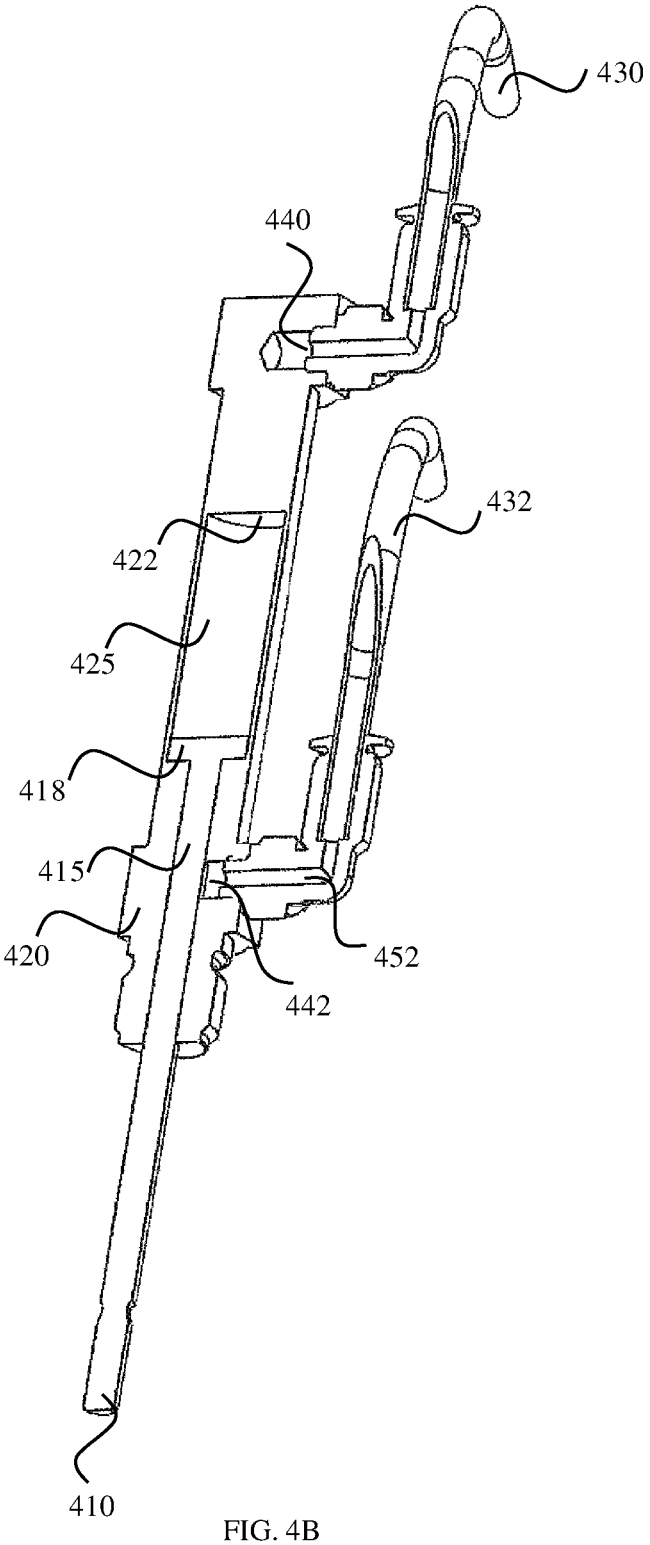

FIGS. 4A-4B show a cross section of a folding unit with a moving member therein, according to exemplary embodiments of the present invention. In FIG. 4A the folding unit is in resting position, while in FIG. 4B the folding unit is in folding position. The folding unit comprises a moving member 415 and a housing 420 carrying the moving member 415. The housing 420 is coupled to the body of the system, for example to a top mount as shown above. The moving member 415 comprises a rear part 418 and a front part 410. The rear part 418 remains inside the housing when the front part 410 folds the top section of the cigarette. The rear part 418 of the moving member 415 moves inside a rear void 425 of the housing 420. As the rear part 418 is wider than the front part 410, is cannot pass the front end of the rear void 425. A rear end 422 of the rear void limits the rear movement of the moving member 415, after touching the cigarette.

The movement of the moving member 415 may be initiated by a controller communicating or electrically coupled to a component of the folding unit. The controller may send a command to a motor located inside the folding unit, such that the motor will move the moving member towards the cigarette.

In some other cases, the controller may inject gas into a chamber in the housing 420, said gas will initiate movement of the moving member 415. The gas may be provided from a gas container coupled to multiple folding units of the system. The controller may control valves that allow passage of gas from the gas container to the folding units. This way, when the controller opens the valves, the moving member 415 moves towards the cigarette or back from the cigarette. When using air in order to move the moving member, the folding unit comprises a front gas connector 432 and a rear gas connector 430. The connectors 430, 432 are connected to a gas tube connected to the valves of the gas container. When the valve connected to the relevant gas tube is open, gas flow via the gas connectors 430, 432 via gas tubes 450, 452 into niches 440, 442. This way, gas reaching rear niche 440 moves the moving member 415 forward, towards the cigarette, while gas reaching front niche 442 moves the moving member 415 rearwards, away from the cigarette.

Figure 5:
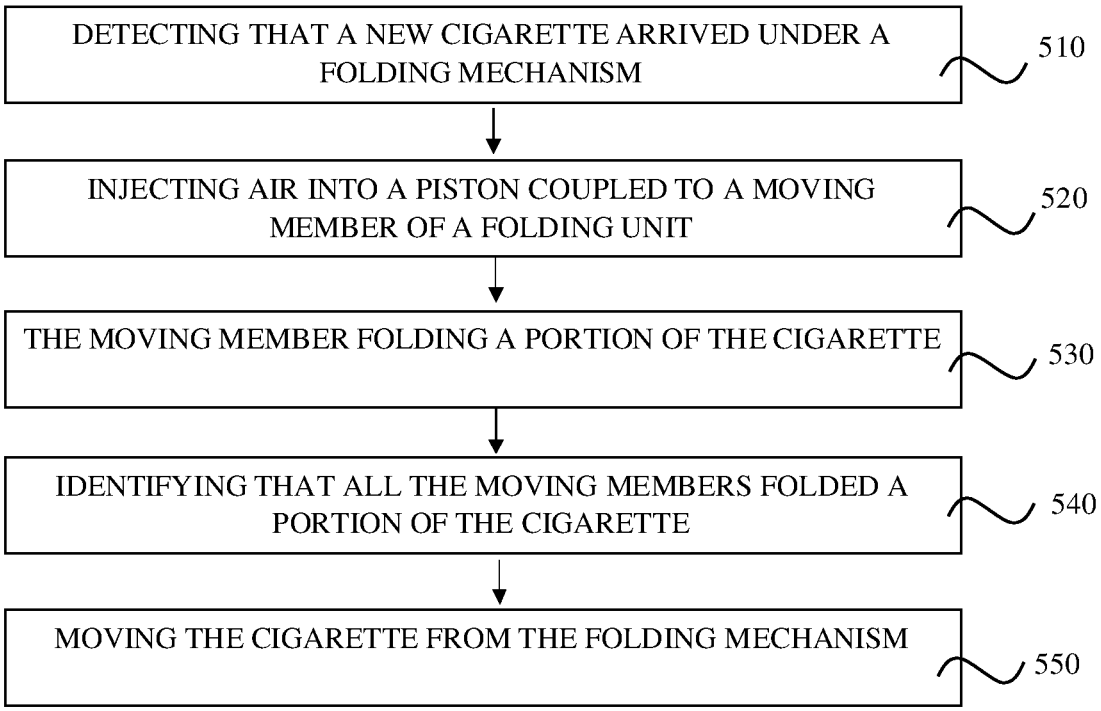
FIG. 5 shows a method for folding a cigarette, according to exemplary embodiments of the present invention.

FIG. 5 shows a method for folding a cigarette, according to exemplary embodiments of the present invention.

Step 510 discloses detecting that a new cigarette arrived under a folding mechanism. The cigarette is mounted inside an insert, which may be maneuvered by the system for manufacturing cigarettes. The detection may result from information collected by a sensor, for example an audio sensor or an image sensor. The detection may be based on a mechanic coupling that takes place when a new insert is placed under the folding mechanism, for example a "click" between two distinct modules. Once a new cigarette is located under the folding mechanism, the controller of the system generates a command to fold the top portion of the cigarette.

Step 520 discloses injecting air into a piston coupled to a moving member of a folding unit. This step is optional and is performed in case the moving member in the folding units moves in response to injection of air. In some other cases, the moving member may move by an actuator, for example using electrical, hydraulic, pneumatic energy or any other technique desired by a person skilled in the art. The injection of air may be provided from an air container, or an air pump. The controller sends a command to a specific valve to open, thereby injecting the air into the appropriate tube connected to the air container. The other side of the tube is connected to the specific folding unit required to fold the top portion of the cigarette. In many cases, the controller commands to open multiple valves when folding a single cigarette, one valve for each direction from which the cigarette is folded, as the direction is equivalent to the folding units.

Step 530 discloses the moving member folding a portion of the cigarette. The moving member moves downwards in order to fold the cigarette. In addition to the downward vector of the moving member's movement, there may be a lateral vector, for example as many of the moving members move in a degree in the range of 30-70 relative to the ground. The direction of the moving member's movement is defined by the angle of the housing of each folding unit relative to the cigarette. The time duration required for folding the upper portion of the cigarette by each moving member is short enough to prevent the folded part to unfold back upwards. It should be noted that the cigarette is made of very thin material, such as paper, which is likely to unfold back after some time. The folding process outputs multiple layers of the top portion, mounted one on top of the other. The time duration of a folding movement, including forward and rearward movement by each moving member may be in the range of 40-250 milliseconds. The length of movement of the moving member when folding the top portion of the cigarette is in the range of 5-80 millimeters in each direction, towards the cigarette and back from the cigarette.

Step 540 discloses identifying that all the moving members folded a portion of the cigarette. As the controller controls the movement of the moving members, for example by injecting air, or by verifying that the folding unit received electrical current from another source, the controller obtains indication which of the folding units folded the cigarette. Once all the folding units folded the cigarette, the folding process is complete.

Step 550 discloses moving the cigarette from the folding mechanism. Moving the cigarette may comprise moving the insert in which the cigarette is mounted. Such movement may include movement of mechanical arms connected to the insert. The folded cigarettes may be moved to a station in which they are packed together.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

While the disclosure has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings without departing from the essential scope thereof. Therefore, it is intended that the disclosed subject matter is not limited to the particular embodiment disclosed as the best mode contemplated for carrying out this invention, but only by the claims that follow.

What is claimed is:

1. A system for folding cigarettes filled with a smoking material, comprising:

a body;

an insert coupled to the body, said insert is configured to store the cigarette, said insert comprises a base and sidewalls extending upwards from the base, wherein the base and the sidewalls match a size of the cigarette, the cigarette is configured to be mounted on a top surface of the base;

a folding mechanism secured to the body, said folding mechanism comprises multiple folding units, each folding unit of the multiple folding units comprises a moving member that moves towards the insert for hitting a top portion of the cigarette from another angle;

a mechanism for moving the moving member towards the cigarette, wherein each folding unit of the multiple folding units has a resting position in which the folding unit is located away from the insert and a folding position in which the folding unit is located near the insert, and a top mount secured to the body and placed above a top most point of the insert, said top mount securing the multiple folding units in the resting position, wherein the entire folding units are located above the top most point of the insert when the multiple folding units are in the resting position.

2. The system of claim 1, further comprising a controller for controlling a time in which each folding unit of the multiple folding units hits a top portion of the cigarette.

3. The system of claim 1, wherein each folding unit of the multiple folding units is located in its entirety in the top mount when the folding unit is in the resting position.

4. The system of claim 1, wherein the top mount is coupled to multiple housings, each of the multiple housings is configured to secure one of the multiple folding units.

5. The system of claim 1, further comprising an adjuster for adjusting a distance between the top mount and the insert.

6. The system of claim 2, wherein each folding unit of the multiple folding units comprises a housing, said housing is coupled to the body and contains the moving member, wherein the moving member moves inside the housing when moving towards the cigarette.

7. The system of claim 1, wherein the mechanism is an air pump, wherein each of the multiple folding units comprises a gas inlet for receiving gas into a niche of the housing, such that passage of the gas into the housing results in movement of the moving member.

8. The system of claim 7, wherein each of the multiple folding units comprises a front gas inlet for receiving gas into a front niche of the housing and a rear gas inlet for receiving gas into a rear niche of the housing, such that passage of the gas into the front niche results in movement of the moving member back from the cigarette and passage of the gas into the rear niche results in movement of the moving member towards the cigarette.

9. The system of claim 8, further comprising a controller for controlling a time in which each folding unit of the multiple folding units hits a top portion of the cigarette, wherein the controller is electrically coupled to multiple valves, each valve of the multiple valves controls gas flow from a gas container to a niche in one of the multiple folding units, such that opening a valve results in movements of a moving member of one of the multiple folding units towards the cigarette or away from the cigarette.

10. The system of claim 1, wherein the base is located in a bottom side of the insert, pointing to the ground.

11. The system of claim 2, wherein the controller commands only one of the folding units to touch the cigarette.

* * * * *